US006724292B2

(12) United States Patent
Miyashita et al.

(10) Patent No.: US 6,724,292 B2
(45) Date of Patent: Apr. 20, 2004

(54) THERMAL FUSE

(75) Inventors: Ikuhiro Miyashita, Shiga (JP); Tokihiro Yoshikawa, Shiga (JP); Michihiko Nishijima, Tokyo (JP); Hideo Kumita, Tokyo (JP)

(73) Assignees: NEC Schott Components Corporation, Minakuchi-cho (JP); Tokuriki Honten Co., Ltd., Tokyo (JP)

( * ) Notice: Subject to any disclaimer, the term of this patent is extended or adjusted under 35 U.S.C. 154(b) by 0 days.

(21) Appl. No.: 10/276,395

(22) PCT Filed: Jul. 18, 2001

(86) PCT No.: PCT/JP01/06257

§ 371 (c)(1),
(2), (4) Date: Nov. 14, 2002

(87) PCT Pub. No.: WO03/009323

PCT Pub. Date: Jan. 30, 2003

(65) Prior Publication Data

US 2003/0112117 A1 Jun. 19, 2003

(51) Int. Cl.[7] ..... H01H 85/06; H01H 85/055

(52) U.S. Cl. ..... 337/290; 337/296; 337/160; 337/416; 337/401; 337/407; 29/623

(58) Field of Search ..... 337/227, 297, 337/232, 166, 159, 160, 298, 401–405, 296, 416; 29/623

(56) References Cited

U.S. PATENT DOCUMENTS

| | | | | | |
|---|---|---|---|---|---|
| 2,486,341 | A | * | 10/1949 | Stumbock | 75/232 |
| 3,180,958 | A | * | 4/1965 | Merrill | 337/409 |
| 3,258,829 | A | * | 7/1966 | Gwyn, Jr. | 29/875 |
| 3,576,415 | A | * | 4/1971 | Gwyn, Jr. | 200/269 |
| 3,596,030 | A | * | 7/1971 | Shibata | 200/266 |
| 3,666,428 | A | * | 5/1972 | Haarbye | 428/547 |
| 3,688,067 | A | * | 8/1972 | Shibata | 200/265 |
| 3,717,793 | A | * | 2/1973 | Peterson | 361/104 |
| 3,781,737 | A | * | 12/1973 | Henry | 337/407 |
| 3,807,994 | A | * | 4/1974 | Jost | 148/527 |

(List continued on next page.)

FOREIGN PATENT DOCUMENTS

| | | | | |
|---|---|---|---|---|
| DE | 3842919 | A1 * | 7/1990 | C23C/24/00 |
| FR | 2133764 | | 12/1972 | |
| JP | 53-83074 | A * | 7/1978 | C22C/5/06 |
| JP | 53149667 | | 12/1978 | |
| JP | 58 110639 | | 7/1983 | |
| JP | 59149620 | | 8/1984 | |
| JP | 62040331 | | 2/1987 | |
| JP | 08073966 | | 3/1996 | |
| JP | 10162704 | | 6/1998 | |

*Primary Examiner*—Anatoly Vortman
(74) *Attorney, Agent, or Firm*—W. F. Fasse; W. G. Fasse

(57) ABSTRACT

An object is to provide a thermal fuse that is free of a trouble of welding contact between a movable electrode (4) and a lead (2) even when temperature of an equipment to which the thermal fuse is connected rises gradually and that has small electric resistance at the time of conduction.

For this purpose, the present invention provides a thermal fuse in which a thermosensitive material (7) is melt at an operation temperature to unload a compression spring (9), and by expansion of the compression spring (9), a movable electrode (4) and a lead (2) that have been in pressure contact by the compression spring (9) are separated to stop electric current, characterized in that material of the movable electrode (4) is obtained by performing internal oxidation process of an alloy having a composition containing 99 to 80 parts by weight of Ag and 1 to 20 parts by weight of Cu, that thickness of a layer having smaller amount of oxide particles at a surface of the material is at most 5 $\mu$m, and that average grain diameter of oxide particles in the material is 0.5 to 5 $\mu$m.

5 Claims, 2 Drawing Sheets

U.S. PATENT DOCUMENTS 3,814,640 A * 6/1974 Shibata ..... 148/277
3,930,215 A * 12/1975 Senor ..... 337/407
3,944,960 A * 3/1976 Audette et al. ..... 337/408
4,050,930 A * 9/1977 Motoyoshi et al. ..... 148/431
4,065,741 A * 12/1977 Sakamoto et al. ..... 337/407
4,068,204 A * 1/1978 Iwanari et al. ..... 337/408
4,075,596 A * 2/1978 Plasko ..... 337/408
4,084,147 A * 4/1978 Mlyniec et al. ..... 337/407
4,109,229 A * 8/1978 Plasko ..... 337/408
4,126,845 A * 11/1978 Iimori et al. ..... 337/408
4,189,697 A * 2/1980 Hara ..... 337/407
4,210,893 A * 7/1980 Hara ..... 337/407
4,242,135 A 12/1980 Shibata
4,246,561 A * 1/1981 McVey ..... 337/407
4,246,564 A * 1/1981 Olson et al. ..... 337/409
4,276,532 A * 6/1981 Aoki ..... 337/408
4,279,649 A * 7/1981 Fujiwara et al. ..... 148/431
4,281,309 A * 7/1981 Olson ..... 337/409
4,330,331 A * 5/1982 Fujiwara et al. ..... 148/557
4,345,130 A * 8/1982 Okutomi et al. ..... 200/268
4,374,311 A * 2/1983 Okahashi et al. ..... 200/269
4,509,980 A * 4/1985 Jost ..... 75/234
4,609,525 A * 9/1986 Schreiner et al. ..... 419/6
4,700,475 A * 10/1987 Jost et al. ..... 29/847
4,821,010 A * 4/1989 Plasko ..... 337/405
4,855,104 A * 8/1989 Rothkegel et al. ..... 419/28
5,246,512 A * 9/1993 Seki et al. ..... 148/668
5,409,519 A * 4/1995 Seki et al. ..... 75/245
5,429,656 A * 7/1995 Hauner et al. ..... 75/232
5,610,347 A * 3/1997 Behrens et al. ..... 75/247
5,796,017 A * 8/1998 Hauner ..... 75/232

* cited by examiner

THERMAL FUSE

TECHNICAL FIELD

The present invention relates to a thermal fuse attached to prevent electronic equipment and electric appliances for home use from attaining to an abnormally high temperature.

BACKGROUND ART

Structure and function of a thermal fuse will be described with reference to FIGS. 1 and 2. FIG. 1 is a cross section of the thermal fuse in a normal state, and FIG. 2 is a cross section after operation. As shown in FIG. 1, the thermal fuse includes, as main components, a metal case 1, leads 2 and 3, an insulating member 5, compression springs 8 and 9, a movable electrode 4 and a thermosensitive material 7. Movable electrode 4 is movable while in contact with an inner surface of metal case 1 which is conductive. Between movable electrode 4 and insulating member 5, compression spring 8 is provided, and between movable electrode 4 and thermosensitive material 7, compression spring 9 is provided. In a normal state, compression springs 8 and 9 are each in compressed states. As compression spring 8 is stronger than compression spring 9, movable electrode 4 is biased to the side of insulating member 5, and movable electrode 4 is in pressure contact with lead 2. Therefore, when leads 2 and 3 are connected to an electric wiring of electronic equipment, for example, a current flows from lead 2 to movable electrode 4, from movable electrode 4 to metal case 1, and from metal case 1 to lead 3, thus conducting power. As the thermosensitive material, an organic substance, for example, adipic acid having a melting point of 150° C. may be used. When a prescribed operating temperature is attained, thermosensitive material 7 softens or melts, and deforms because of the load from compression spring 9. Therefore, when electronic equipment or the like to which the thermal fuse is connected is overheated to reach the prescribed operation temperature, thermosensitive material 7 deforms and unloads compression spring 9. As compression spring 9 expands, compressed state of compression spring 8 is released in response, and as compression spring 8 expands, movable electrode 4 is separated from lead 2, thus cutting current, as shown in FIG. 2. By connecting the thermal fuse having such a function to an electric wire of electronic equipment and the like, damage to the equipment body or fire caused by abnormal overheating of the equipment can be prevented.

When the temperature to which the thermal fuse is connected increases rapidly, thermosensitive material 7 quickly softens, melts and deforms, and therefore lead 2 and movable electrode 4 are quickly separated. When the temperature rises gradually, however, thermosensitive material 7 softens, melts and deforms gradually, and therefore separation between lead 2 and movable electrode 4 proceeds gradually as well. As a result, a slight arc tends to be generated locally between lead 2 and movable electrode 4, which arc possibly causes welding contact between movable electrode 4 and lead 2, causing a problem that the function of the thermal fuse is lost.

When Ag—CdO is selected as the material of movable electrode 4, for example, Ag—CdO is superior in that it has low electric resistance and high thermal conductivity. When an arc is generated between lead 2 and movable electrode 4, however, there arises a problem that the welding contact phenomenon with lead 2 tends to occur, as CdO is significantly volatilized and sublimated in a closed space by the arc as CdO has high vapor pressure and movable electrode 4 formed of Ag—CdO is apt to be deformed.

Such a problem of welding contact may be improved by increasing content of CdO in Ag—CdO. When the content of CdO is increased, however, contact resistance with lead 2 increases, so that temperature at the contact portion tends to be increased. Thus, performance of the thermal fuse degrades.

When an Ag alloy oxide material is used as the material of movable electrode 4, the problem of welding contact is less likely when the oxide dispersed in the Ag alloy oxide material is fine particles. The oxide as the fine particles, however, increases contact resistance with lead 2, and as the temperature at the contact portion increases, the above described problem of degraded performance of the thermal fuse results.

An object of the present invention is to provide a thermal fuse that is free of any trouble of welding contact between the movable electrode and lead 2, even when the temperature of the equipment to which the thermal fuse is connected rises gradually, and that has small electric resistance at the time of conduction.

DISCLOSURE OF THE INVENTION

The present invention provides a thermal fuse in which a thermosensitive material is melt at an operation temperature to unload a compression spring, and by the expansion of the compression spring, a movable electrode and a lead that have been in pressure contact by the compression spring are separated to stop electric current, characterized in that the material of the movable electrode is obtained by performing internal oxidation process of an alloy having a composition containing 99 to 80 parts by weight of Ag and 1 to 20 parts by weight of Cu, that thickness of a layer having smaller amount of oxide particles at a surface of the material is at most 5 $\mu$m, and that average grain diameter of oxide particles in the material is 0.5 to 5 $\mu$m.

Preferably, the internal oxidation process is performed at an oxygen partial pressure of 0.3 to 2 MPa.

In the thermal fuse in accordance with the present invention, the material of the movable electrode may be an alloy having a composition containing 0.1 to 5 parts by weight of at least one of Sn and In.

The material of the movable electrode may be an alloy of a composition containing 0.01 to 1 parts by weight of at least one selected from the group consisting of Fe, Co, Ni and Ti.

In the present invention, the material of the movable electrode is preferably an alloy of a composition containing 0.1 to 5 parts by weight of at least one of Sn and In and 0.01 to 1 parts by weight of at least one selected from the group consisting of Fe, Co, Ni and Ti.

BEST MODE FOR CARRYING OUT THE INVENTION

Figure 1:
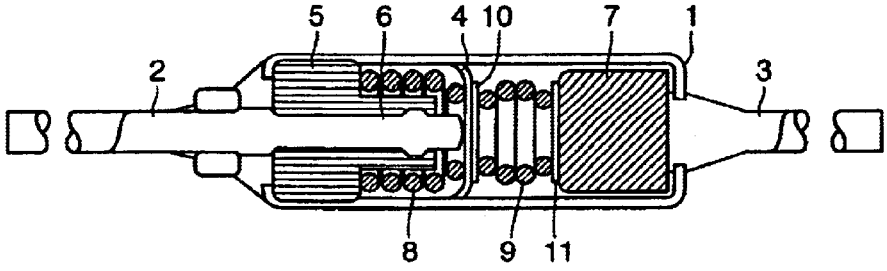
FIG. 1 PRIOR ART
FIG. 1 is a cross sectional view of the thermal fuse in a normal state.
Figure 2:
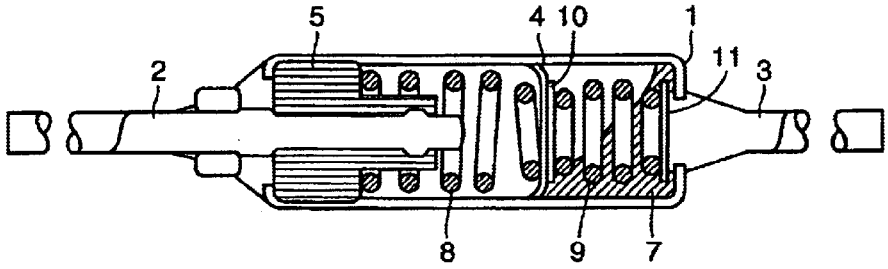
FIG. 2 PRIOR ART
FIG. 2 is a cross sectional view of the thermal fuse after operation.

The present invention relates to a thermal fuse in which the material of a movable electrode is obtained by performing internal oxidation process of an alloy containing Ag and Cu, thickness of a layer having smaller amount of oxide particles at the surface of the material has the thickness of at most 5 μm and average grain diameter of oxide particles in the material is 0.5 to 5 μm.

The material of the movable electrode is obtained by performing internal oxidation process of an alloy containing Ag and Cu. The Cu oxide introduce to an Ag matrix has vapor pressure lower than a Cd oxide at a high temperature. Therefore, even when there is a slight arc generated locally between lead 2 and movable electrode 4, the Cu oxide is less susceptible to volatilization and sublimation as compared with the Cd oxide. Therefore, by introducing the Cu oxide in place of the conventionally used Cd oxide, welding contact between movable electrode 4 and lead 2 can effectively be suppressed.

The composition of Ag and Cu occupying the alloy as the raw material of the movable electrode is as follows: 99 to 80 parts by weight of Ag and 1 to 20 parts by weight of Cu; preferably, 94 to 86 parts by weight of Ag and 6 to 14 parts by weight of Cu; and more preferably, 92 to 88 parts by weight of Ag and 8 to 12 parts by weight of Cu. When the amount of introduced Cu becomes smaller than 1 part by weight with respect to 99 parts by weight of Ag, the effect of Cu is insufficient, so that welding contact between movable electrode 4 and lead 2 tends to occur and the function of the thermal fuse is lost. When the amount of introduced Cu becomes larger than 20 parts by weight with respect to 80 parts by weight of Ag, electric resistance at the contact portion between lead 2 and movable electrode 4 increases, the temperature at the contact portion increases at the time of conduction, and the performance of the thermal fuse is degraded.

In the present invention, the material of movable electrode 4 is obtained by performing internal oxidation process of an alloy containing Ag and Cu. The internal oxidation process refers to selective oxidation of a surface layer of a composition metal, as oxygen diffuses from the surface to the inside of the alloy when the alloy is exposed to a high temperature in an atmosphere to which oxygen is sufficiently supplied. By performing the internal oxidation process of the alloy containing Ag and Cu, Cu is selectively oxidized, and CuO results as an oxide in the alloy. In the present invention, as the material of the movable electrode, an alloy of Ag and Cu that has been subjected to internal oxidation process under a prescribed condition is used in place of an alloy of Ag—CuO, whereby the thickness of the layer having smaller amount of oxide particles at the surface of the material can be made at most 5 μm, and the average grain diameter of the oxide particles in the material can be made to 0.5 to 5 μm. Thus, a thermal fuse can be provided that is free of any trouble of welding contact even when the temperature increases gradually and that has small electric contact at the time of conduction.

In the thermal fuse of the present invention, the material of the movable electrode may be an alloy of a composition containing at least one Sn and In. As Sn or In is introduced, a compound oxide such as (Cu—Sn) $O_x$, (Cu—In) $O_x$ or (Cu—Sn—In) $O_x$ results after internal oxidation process, and resistance against welding contact caused by slight arc locally generated between the lead and the movable electrode is significantly improved.

Composition of Sn or In occupying the alloy as the raw material may preferably be 0.1 to 5 parts by weight with respect to 99 to 80 parts by weight of Ag and 1 to 20 parts by weight of Cu, more preferably 0.5 to 4 parts by weight, and most preferably, 1 to 3 parts by weight. When Sn or In is smaller than 0.1 parts by weight, arc characteristic cannot sufficiently be improved, and when it is larger than 5 parts by weight, it causes increase contact resistance. A composition in which Sn or In is contained by 0.1 to 5 weight %, and Ag and Cu are contained by 99.9 to 95 weight % with respect to the entire alloy component is preferred.

The material of the movable electrode may be an alloy having a composition containing at least one selected from the group consisting of Fe, Co, Ni and Ti. During the internal oxidation process, there is generated a steep concentration gradient between the oxide and not-yet-oxidized substance. Therefore, the not-yet-oxidized substance moves from the inside to the surface, possibly resulting in unevenness between the surface layer and the inside. Introduction of Fe, Co, Ni or Ti suppresses movement of the not-yet-oxidized substance during the internal oxidation process, and uniform dispersion of the oxide is attained.

The composition of Fe, Co, Ni or Ti occupying the alloy as the raw material may preferably be 0.01 to 1 parts by weight with respect to 99 to 80 parts by weight of Ag and 1 to 20 parts by weight of Cu, more preferably, 0.05 to 0.5 parts by weight, and most preferably, 0.2 to 0.4 parts by weight. When the amount of introduced Fe, Co, Ni or Ti is smaller than 0.01 parts by weight, movement of the not-yet-oxidized substance cannot sufficiently be suppressed during the internal oxidation process, making it difficult to attain uniform dispersion of the oxide. When the amount is larger than 1 part by weight, coarse oxide is formed at grain boundaries, for example, which may cause increased contact resistance. A composition that contains 0.01 to 1 weight % of Fe, Co, Ni or Ti, and Ag and Cu by 99.99 to 99 weight % with respect to the entire alloy component is preferred.

In a more preferred embodiment, in the present invention, an alloy having a composition that contains 99 to 80 parts by weight of Ag, 1 to 20 parts by weight of Cu, 0.1 to 5 parts by weight of at least one of Sn and In, and 0.01 to 1 parts by weight of at least one selected from the group consisting of Fe, Co, Ni and Ti may be used as the raw material of the movable electrode material. The movable electrode obtained from the alloy of such a composition is of the material having contact resistance lower than that attained simply by combining advantages of respective components, and such a synergistic effect can be obtained that temperature increase at the time of conduction is suppressed and superior arc resistance is obtained. A composition that contains 0.1 to 5 weight % of Sn or In, 0.01 to 1 weight % of Fe, Co, Ni or Ti, and 99.8 to 94 weight % of Ag and Cu with respect to the entire alloy component is preferred.

The thickness of the layer having smaller amount of oxide particles at the surface of the movable electrode is at most 5 μm, preferably at most 3 μm and more preferably, at most 1 μm. When the layer having smaller amount of oxide particles is thicker than 5 μm, the surface layer would have a composition close to pure Ag, making welding contact between movable electrode 4 and lead 2 more likely. Here, the surface layer of the movable electrode refers to a layer from the surface to about 20 μm of the movable electrode, and the layer having smaller amount of oxide particles refers to a layer in which oxide concentration is lower than about 1 weight %.

The average grain diameter of the oxide particles at the surface layer of movable electrode 4 is 0.5 to 5 μm, preferably, 1 to 4 μm and, more preferably, 2 to 3 μm. When the average grain diameter of the oxide particles is smaller than 0.5 μm, welding contact becomes more likely as the grain diameter of the oxide particles is small at the contact portion between lead 2 and movable electrode 4. When the grain diameter of the oxide particles is larger than 5 μm, contact resistance increases, and therefore, welding contact becomes more likely.

The material of the movable electrode may be manufactured by performing internal oxidation process on the alloy having the above described composition with oxygen partial pressure of 0.3 to 2 MPa. The oxygen partial pressure at the time of internal oxidation process is preferably, 0.3 to 2 MPa, more preferably, 0.4 to 1 MPa and, most preferably, 0.5 to 0.9 MPa. The oxygen partial pressure at the time of internal oxidation process is important to suppress generation of the layer having smaller amount of oxide particles at the surface of the movable electrode and to adjust the average grain diameter of the oxide particles to 0.5 to 5 μm. More specifically, when the oxygen partial pressure is smaller than 0.3 MPa, the function of suppressing generation of the layer having smaller amount of oxide particles is insufficient, making welding contact more likely, and in addition, average grain diameter of the oxide particles becomes larger than 5 μm. When the oxygen partial pressure is larger than 2 MPa, the average grain diameter of the oxide particles becomes smaller than 0.5 μm, and as a result, welding contact of the surface layer of the movable electrode becomes more likely, as already described. The temperature at the time of internal oxidation process is preferably 500 to 780° C., and more preferably 550 to 700° C. When the temperature is lower than 500° C., oxidation reaction does not proceed sufficiently. When the temperature is higher than 780° C., it becomes difficult to control the thickness of the layer having smaller amount of oxide particles and the size of the oxide particles.

The present invention will be described in greater detail with reference to specific examples.

EXAMPLES 1 to 18

Alloy components as raw materials of the movable electrode were mixed to have such compositions as shown in Table 1, the resulting compositions were subjected to fusion, forging and thereafter rolling to a prescribed thickness. Using an internal oxidation furnace, internal oxidation process was performed with the oxygen partial pressure of 0.5 MPa, at 550° C. for 30 hours. Thereafter, rolling process is performed for finishing, and press processing was performed, whereby movable electrodes of a prescribed shape were obtained. The thickness of the layer having smaller amount of oxide particles at the surface and the size of the oxide particles (average grain diameter) of each movable electrode were evaluated. Further, a thermosensitive material of adipic acid having a melting point of 150° C. and movable electrodes obtained from each of the raw materials were mounted on thermal fuses having the structure shown in FIG. 1, and conduction test and current breaking test were conducted, with the setting of DC30V, 20A and temperature rising rate of 1° C./min.

(Method of Evaluation)

1. Thickness of Layer Having Smaller Amount of Oxide Particles

Figure 3:
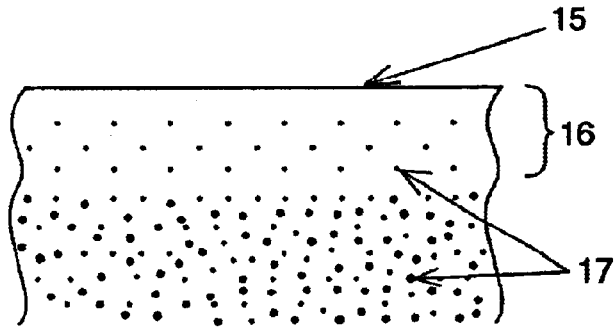
FIG. 3 is a schematic cross sectional view of a surface layer portion of the movable electrode in accordance with the present invention.

As shown in FIG. 3, at a cross section of movable electrode 4, a region of which oxide concentration is lower than 1% is regarded as layer having smaller amount of oxide particles 16. Using an electron microscope, quantitative analysis of the oxide was performed 1 μm by 1 μm from the outermost surface to the center of the cross section, and the thickness of the layer having smaller amount of oxide particles 16 was measured.

2. Size of the Oxide Particles

Average grain diameter of oxide particles 17 was measured at the surface of movable electrode 4, by using a metallurgical microscope at a magnification of 1000 times.

3. Conduction Test

Power is fed for 10 minutes to the thermal fuses. Temperature difference at the surface of metal case 1 before and after the test was measured, and fuses of which temperature different was smaller than 10° C. were evaluated as successful, ○, and those with the temperature difference of 10° C. or larger were evaluated as failure, x.

4. Current Breaking Test

After power was fed for 10 minutes to the thermal fuses, temperature of test environment was increased to 160° C., which is higher by 10° C. than the operation temperature of 150° C., while continuing power conduction. The thermal fuses were actually operated, to see current breaking performance. After the test, fuses in which welding contact did not occur between the movable electrode and the lead 2, that is, ones that could successively break the current were evaluated as successful, ○, and ones suffered from welding contact, that is, those that could not break the current, were evaluated as failure, x.

Comparative Examples 1, 2

Movable electrodes were manufactured under the same conditions as Examples 1 to 3 except that 8.0 parts by weight and 12.0 parts by weight of Cd were respectively introduced in place of Cu, thickness of the layer having smaller amount of oxide particles and the size of the oxide particles were evaluated, and conduction test and current breaking test were performed.

Component compositions of the raw materials of the movable electrode materials, and results of respective evaluations are as shown in Table 1.

TABLE 1

| | Component Composition (Parts by Weight) of Raw Material | | | | | | | | | Thickness of Layer Having Smaller Amount of Oxide Particles | Size of Oxide Particles | Conduction | Current Breaking |
|---|---|---|---|---|---|---|---|---|---|---|---|---|---|
| | Ag | Cu | Cd | Sn | In | Fe | Co | Ni | Ti | (μm) | (μm) | Test | Test |
| Example 1 | 98.9 | 1.1 | | | | | | | | 2 | 1.2 | ○ | ○ |
| Example 2 | 89.4 | 10.6 | | | | | | | | 3 | 2.6 | ○ | ○ |
| Example 3 | 81.3 | 18.7 | | | | | | | | 4 | 4.1 | ○ | ○ |
| Example 4 | 98.1 | 1.4 | | | | 0.5 | | | | 3 | 1.1 | ○ | ○ |

TABLE 1-continued

| | Component Composition (Parts by Weight) of Raw Material | | | | | | | | | Thickness of Layer Having Smaller Amount of Oxide Particles | Size of Oxide Particles | Conduction | Current Breaking |
|---|---|---|---|---|---|---|---|---|---|---|---|---|---|
| | Ag | Cu | Cd | Sn | In | Fe | Co | Ni | Ti | (μm) | (μm) | Test | Test |
| Example 5 | 89.9 | 9.8 | | | | | 0.3 | | | 3 | 1.6 | ○ | ○ |
| Example 6 | 80.1 | 19.2 | | | | | | 0.7 | | 2 | 3.9 | ○ | ○ |
| Example 7 | 98.5 | 1.3 | | | | | | | 0.2 | 2 | 1.3 | ○ | ○ |
| Example 8 | 90.6 | 8.9 | | | | 0.2 | 0.3 | | | 1 | 1.5 | ○ | ○ |
| Example 9 | 81.0 | 18.2 | | | | | 0.1 | 0.4 | 0.3 | 2 | 3.2 | ○ | ○ |
| Example 10 | 88.5 | 11.0 | | | | 0.1 | 0.1 | 0.1 | 0.2 | 1 | 2.3 | ○ | ○ |
| Example 11 | 93.3 | 1.9 | | 4.8 | | | | | | 3 | 0.8 | ○ | ○ |
| Example 12 | 89.3 | 8.7 | | 2.0 | | | | | | 3 | 3.1 | ○ | ○ |
| Example 13 | 80.2 | 19.5 | | 0.2 | 0.1 | | | | | 2 | 1.7 | ○ | ○ |
| Example 14 | 95.9 | 1.6 | | | 2.5 | | | | | 2 | 0.8 | ○ | ○ |
| Example 15 | 85.6 | 9.7 | | | 4.7 | | | | | 2 | 1.1 | ○ | ○ |
| Example 16 | 80.6 | 19.0 | | 0.1 | | 0.3 | | | | 1 | 1.0 | ○ | ○ |
| Example 17 | 89.5 | 9.8 | | | 0.1 | | 0.2 | 0.4 | | 1 | 0.9 | ○ | ○ |
| Example 18 | 88.5 | 10.3 | | 0.1 | 0.3 | 0.2 | 0.1 | 0.4 | 0.1 | 1 | 0.7 | ○ | ○ |
| Comparative Example 1 | 92.0 | | 8.0 | | | | | | | 5 | 2.2 | ○ | x |
| Comparative Example 2 | 88.0 | | 12.0 | | | | | | | 4 | 3.0 | ○ | x |

From Examples 1 to 3 and Comparative Examples 1 and 2, it is understood that thermal fuses using 8.0 parts by weight and 12.0 parts by weight of Cd as the raw material of movable electrode material both had the movable electrode and the lead 2 welding-contacted in the current breaking test, while thermal fuses using 1 to 20 parts by weight of Cu in place of Cd were free of the welding contact, and the current was surely broken at the set temperature of 150° C.

From Examples 4 to 10, it was understood that in thermal fuses using 0.01 to 1 parts by weight of Fe, Co, Ni and Ti as materials of the movable electrode, the oxide was dispersed more uniformly, and that Fe, Co, Ni and Ti had the function of suppressing movement of solute elements that were not yet oxidized in the alloy, during the internal oxidation process.

Referring to Examples 11 to 15, from the inspection of movable electrodes 4 after test of the thermal fuses using 0.1 to 5 parts by weight of Sn or In as the material of movable electrode 4, it was understood that Sn and In had the effect of stably enhancing arc characteristic at the contact portion between lead 2 and movable electrode 4.

Referring to Examples 16 to 18, when Fe, Co, Ni or Ti, and Sn or In were used together as the material of the movable electrode, the effect that contact resistance was lowered, increase in temperature at the time of conduction could be suppressed and deformation of the movable electrode after test was reduced, were exhibited.

Industrial Field of Applicability

According to the present invention, a thermal fuse can be provided that is free of the trouble of welding contact between movable electrode 4 and lead 2 even when the temperature of the equipment to which the thermal fuse is connected rises gradually and that has small electric resistance at the time of conduction.

What is claimed is:

1. A thermal fuse in which a thermosensitive material (7) is melt at an operation temperature to unload a compression spring (9), and by expansion of the compression spring (9), a movable electrode (4) and a lead (2) that have been in pressure contact by the compression spring (9) are separated to stop electric current, characterized in that material of said movable electrode (4) is obtained by performing internal oxidation process of an alloy having a composition containing 99 to 80 parts by weight of Ag and 1 to 20 parts by weight of Cu, that thickness of a layer having smaller amount of oxide particles at a surface of the material is at most 5 μm, and that average grain diameter of oxide particles in the material is 0.5 to 5 μm.

2. The thermal fuse according to claim 1, wherein the internal oxidation process is performed with oxygen partial pressure of 0.3 to 2 MPa.

3. The thermal fuse according to claim 1, wherein the material of the movable electrode (4) is obtained by performing internal oxidation process of an alloy having a composition containing 99 to 80 parts by weight of Ag, 1 to 20 parts by weight of Cu and 0.1 to 5 parts by weight of at least one of Sn and In.

4. The thermal fuse according to claim 1, wherein the material of the movable electrode (4) is obtained by performing internal oxidation process of an alloy having a composition containing 99 to 80 parts by weight of Ag, 1 to 20 parts by weight of Cu, and 0.01 to 1 parts by weight of at least one selected from the group consisting of Fe, Co, Ni and Ti.

5. The thermal fuse according to claim 1, wherein the material of the movable electrode (4) is obtained by performing internal oxidation process of an alloy having a composition containing 99 to 80 parts by weight of Ag, 1 to 20 parts by weight of Cu, 0.1 to 5 parts by weight of at least one of Sn and In, and 0.01 to 1 parts by weight of at least one selected from the group consisting of Fe, Co, Ni and Ti.

* * * * *